US006371536B1

(12) United States Patent
Koerwer et al.

(10) Patent No.: US 6,371,536 B1
(45) Date of Patent: Apr. 16, 2002

(54) MOTOR VEHICLE DOOR LOCK OR THE LIKE

(75) Inventors: Matthias Koerwer, Wuppertal; Bernardo Erices, Berg. gladbach; Robert Hugel, Karlsruhe, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/505,844

(22) Filed: Feb. 17, 2000

(30) Foreign Application Priority Data

Feb. 18, 1999 (DE) ..... 199 06 997

(51) Int. Cl.[7] ..... E05C 3/06
(52) U.S. Cl. ..... 292/201; 292/216
(58) Field of Search ..... 292/216, 201, 292/DIG. 23; 70/277, 279.1, 282

(56) References Cited

U.S. PATENT DOCUMENTS 3,572,066 A * 3/1971 Peters ..... 70/156
6,102,454 A * 8/2000 Weyerstall ..... 292/201

FOREIGN PATENT DOCUMENTS

DE 44 36 617 5/1996
DE 196 50 826 6/1998
DE 197 13 864 10/1998
DE 197 25 416 1/1999
EP 0 903 457 3/1999

* cited by examiner

*Primary Examiner*—Gary Estremsky
(74) *Attorney, Agent, or Firm*—Nixon Peabody LLP; David S. Safran

(57) ABSTRACT

A motor vehicle door lock with a lock latch (4) and a detent pawl (5) which holds the lock latch (4) in the locked position (main catch (4*a*) and optionally a preliminary catch (4*b*)) and with a motorized opening drive (6), the motorized opening drive (6) having a drive motor (7) which is preferably an electric motor and has a step-down gear (8) which, on the driven side engages the detent pawl (5) of a detent pawl lever (9) or the like which moves the detent pawl (5) and lifts the detent pawl (5) when the drive motor (7) is triggered accordingly, so that the lock latch (4) is released—opening position. This releasing is optimized with regard to opening forces by a lifting spring (11) being provided which acts in the lifting direction of the detent pawl (5) in association with the step-down gear (8) or the detent pawl lever (9) or the like, so that the lifting spring (11) is tensioned when the opening drive (6) reverses from the open position into the locked position and so that the lifting spring (11) reinforces the opening motion and the lifting motion of the detent pawl (5) with its spring force when the opening drive (6) is advanced from the locked position into the open position.

14 Claims, 2 Drawing Sheets

MOTOR VEHICLE DOOR LOCK OR THE LIKE

BACKGROUND OF THE INVENTION

1. Field of the Invention

The invention relates to a motor vehicle door lock or the like with a lock latch and a detent pawl which holds the lock latch in the locked position (main catch and optionally a preliminary catch) and with a motorized opening drive, the motorized opening drive having an electric drive motor and having a step-down gear which, on the driven side, engages the detent pawl or a detent pawl lever or the like which moves the detent pawl and lifts the detent pawl when the drive motor is triggered so that the lock latch is released into an open position.

2. Description of Related Art

Motor vehicle door locks or the like with an electrical motor-operated opening drive are known in many embodiments. Recently, especially, pure electric locks have become known; they are motor vehicle door locks which have no mechanical actuating mechanisms or have mechanical operating mechanisms only for emergencies (German Patent DE-C-44 36 617).

One problem in motor vehicle door locks or the like with an opening drive is that opening must be reliably possible even when very high forces which lead to high adhesive friction between the detent pawl and the lock latch in the closed position load the lock latch in the opening direction. This means that the electric drive motor of the opening drive and the step-down gear must be designed such that they still reliably enable opening even in this least favorable case. This leads to the requirement that either the electric drive motor of the opening drive must be made very large, with the consequence that often the opening drive can no longer be accommodated in the housing of the motor vehicle door lock itself (see also German Patent DE-C-44 36 617) and/or that the step-down ratio of the step-down gear must be so large that opening by the opening drive takes an extraordinarily long time. Actuating times of several hundred millisecond are by no means unusual. Accustomed to the opening times of mechanically actuated motor vehicle door locks or the like, these actuation time are perceived as annoyingly long by the user.

SUMMARY OF THE INVENTION

Thus, a primary object of the present invention is to devise a motor vehicle door lock or the like with a motorized opening drive which ensures reliable lifting of the detent pawl from the corresponding catch of the lock latch, even with increased force on the locking wedge, with an opening duration which is as short as possible.

The aforementioned object in a motor vehicle door lock or the like is achieved in a lock of the type initially mentioned above by the fact that a lifting spring which acts in the lifting direction of the detent pawl is assigned to the step-down gear or the detent pawl lever or the like, that the lifting spring is tensioned when the opening drive reverses from the open position into the locked position, and that the lifting spring, when the opening drive is advanced from the locked position into the open position, the spring force of the lifting spring reinforces the forward motion and the lifting motion of the detent pawl. In accordance with the invention, to increase the torque necessary for opening the motor vehicle door lock or the like, the torque which is available for lifting the detent pawl, in accordance with the invention, is composed of the torque of the drive motor and the torque of the lifting spring. Also, for increased forces on the locking wedge or on the lock latch, reliable and prompt opening is ensured. Conversely, it is simply necessary for the drive motor of the opening drive to also be loaded during its return motion from the opening position into the closed position, especially by the tensioning of the lifting spring.

In general, it should be pointed out that the teaching of the invention relates to motor vehicle door locks or the like, especially to side door locks, but also to rear door locks, rear hatch locks and hood locks. Furthermore, it should be emphasized that the drive motor of the motorized opening drive will preferably be an electric drive motor, but that, fundamentally, also other drive motors, for example, pneumatic drives or hydraulic motors, can be used.

The teaching of the invention is especially important in conjunction with a keyless motor vehicle door locking system, therefore with automatic identification of the operator, etc. Here, especially prompt opening of the motor vehicle door lock is necessary; this corresponds to natural handling which is customary in mechanical motor vehicle door locks. The approach according to the invention meets these requirement to a special degree.

These and further objects, features and advantages of the present invention will become apparent from the following description when taken in connection with the accompanying drawings which, for purposes of illustration only, show a single embodiment in accordance with the present invention.

DETAILED DESCRIPTION OF THE INVENTION

Figure 1:
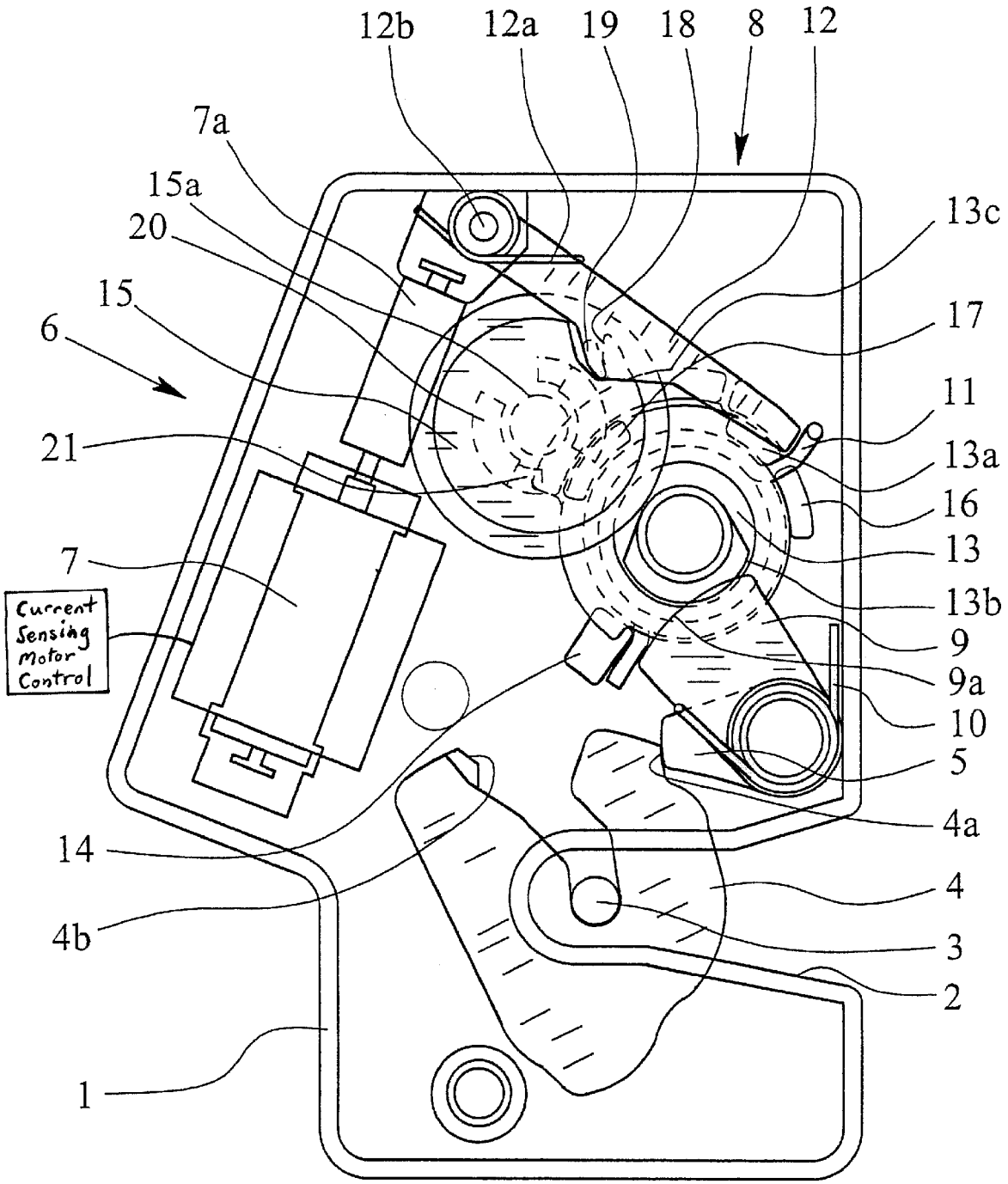
FIG. 1 shows a preferred embodiment of a highly compact motor vehicle door lock as in accordance with the invention as an electric side door lock with the locking components being in the locked position.

The motor vehicle door lock or the like which is shown in FIG. 1 in the embodiment of a side door lock has, first of all, a housing 1 with an inlet slot 2 for a locking wedge which is schematically shown here as a journal-like locking pin 3. The prior art gives a host of alternative embodiments of these locking wedges and the invention encompasses the use of any known type of locking wedge, not merely the pin type shown.

FIG. 1 shows the locked position of the motor vehicle door lock with the lock latch 4, here in the form of a forked rotary latch (having a main catch 4*a* and a preliminary catch 4*b*) which, in the locked position shown, is held by a detent pawl 5 which, in this case, is exposed to pressure. Alternatively, tensile-stressed detent pawls or also special annular detent pawls, as are known and to which reference should be made to the prior art, can be used.

In the preferred embodiment shown, the motorized opening drive is an electric motor operated opening drive 6; however, other types of drives, for example, pneumatic drives or hydraulic motors, can be used instead of the electric motor operated opening drive 6. The illustrated opening drive 6 has an electric drive motor 7 which is connected to a step-down gear, indicated generally at 8, that engages, on the driven side, the detent pawl 5, or as here, a detent pawl lever 9 or the like which moves the detent pawl 5. The detent pawl lever 9 is connected to the detent pawl 5, in the embodiment shown, via a free-wheeling clutch which acts in one direction, so that the detent pawl 5, with the lock latch 4 opened, can be held by the lock latch 4 itself in the raised position, although the detent pawl lever 9 has already reached the engaged position for the detent pawl 5 again (the position shown in FIG. 1). The detent pawl 5 is spring loaded here, as is known from the prior art for these cases, by means of a leg spring 10 in the engaged direction.

Figure 2:
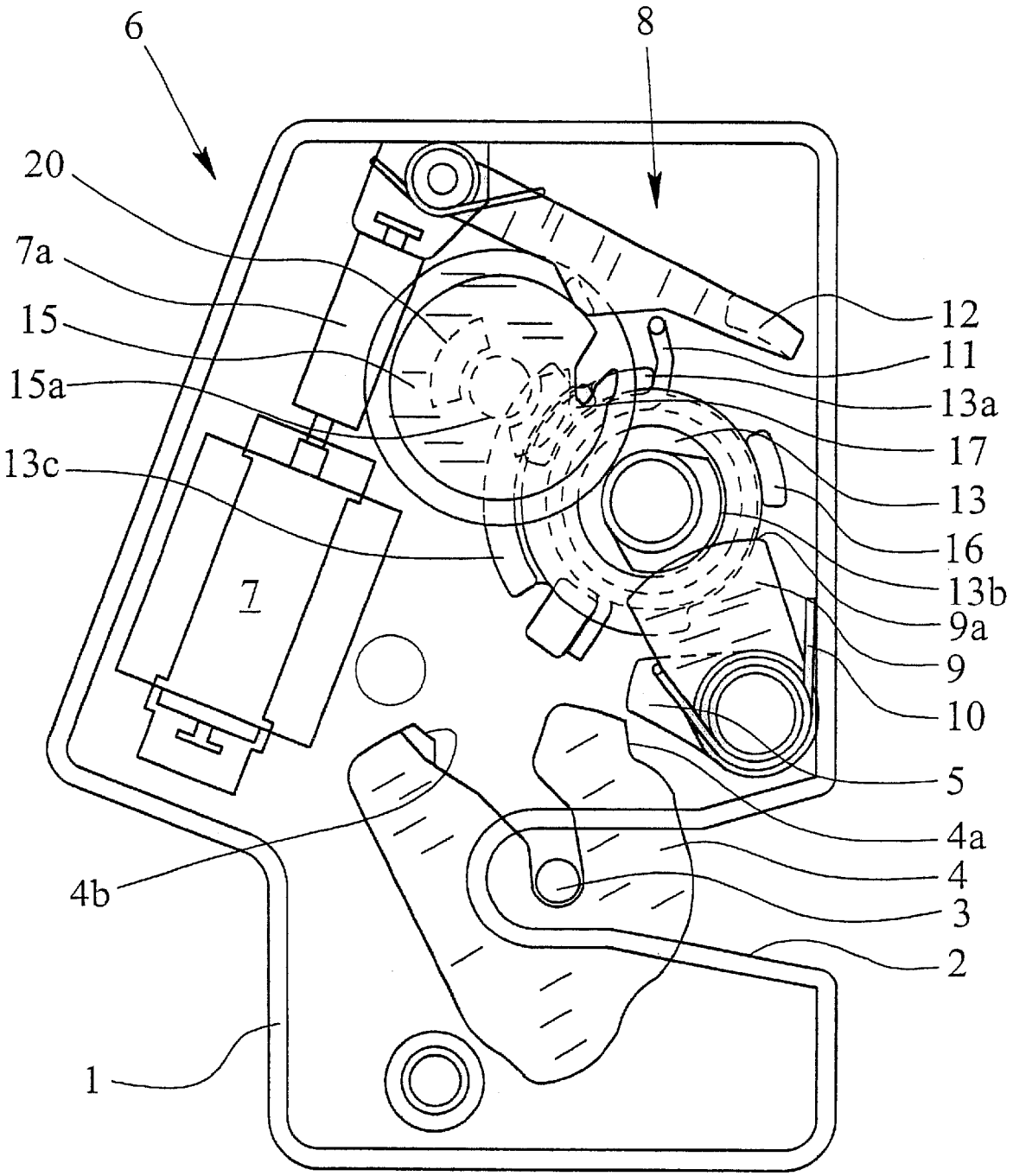
FIG. 2 is a view corresponding to that of FIG. 1, but showing the motor vehicle door lock with the locking elements in the open position.

With the corresponding actuation of the electric drive motor 7, the detent pawl 5 is moved out of the locked position, which is shown in FIG. 1, and is raised from the corresponding catch on the lock latch 4, here the main catch 4*a*, so that the lock latch 4 is released (this is then the open position which is shown in FIG. 2).

It is important for the desired functioning of the lock so as to achieve the object according to the invention that a lifting spring 11, which acts in the lifting direction of the detent pawl 5, is assigned to the step-down gear 8 (or also the detent pawl lever 9). The lifting spring 11 is tensioned when the opening drive 6 reverses from the open position into the locked position, and when the opening drive 6 is advanced from the locked position into the open position, reinforces the forward motion, and thus the lifting motion of the detent pawl 5, with its spring force. In this embodiment, the movement of lifting spring 11 (which is made as a leg spring in this embodiment) can be easily understood.

FIG. 1 shows the locked position from which the lifting spring 11, supporting the lifting motion of the detent pawl 5, is moved in the opening direction into the position which is shown in FIG. 2. The spring force of the lifting spring 11 therefore reinforces the opening force which is applied by the electric drive motor 7; this enables opening even with increased force on the locking wedge 3 and thus increased friction between the detent pawl 5 and the lock latch 4; in addition, the opening times are greatly shortened both for this special case and also under normal load.

The advantage of the construction in accordance with the invention lies not only in the two aforementioned aspects. Add to this is the fact that, with a corresponding configuration of the lifting spring 11, the electric drive motor 7 can be made clearly smaller than in the prior art with consideration of the initially mentioned prerequisites. Construction space, weight, and costs are saved as a result.

So far nothing has yet been stated about how the reset force of the lifting spring 11, which results when the lifting spring 11 is tensioned, can be accommodated in the released state, therefore in the locked position of the motor vehicle door lock or the like. This arises via the gear itself for a step-down gear 8 which is made self-locking. In a step-down gear 8 which is made not to be self-locking, of which there is also one in this preferred embodiment, additional measures must be taken here which can, however, also be taken in a self-locking step-down gear 8.

This embodiment shows one especially advantageous construction which is characterized in that the lifting spring 11 is assigned a retaining element 12 which accommodates the reset force of the lifting spring 11, which acts as a stop for the lifting spring 11, and which is active in the locked position. This retaining element 12 which is made, in this embodiment, as a pivot lever that is coupled and pretensioned in the engaging direction by means of a leg spring 12*a* at one end and is lifted at an opposite end (directly after starting the advancing motion of the opening drive 6 by means of the step-down gear 8) to release the lifting spring 11. Beforehand, the retaining element 12 blocks the return motion of the lifting spring 11, absorbing its spring force and diverting it into the housing 1 via the bearing axle 12*b* of the retaining element 12. Thus, the step-down gear 8 is completely relieved of the spring force of the lifting spring 11 in the released state, i.e., in the locked position. The reset force of the lifting spring 11 takes effect only when necessary, specifically, immediately after starting the opening drive 6 for purposes of unlocking the motor vehicle door.

As explained, this embodiment is especially important when a step-down gear 8 is used which is made not of self-locking type; although, it is also advantageous to use with a step-down gear 8 which is of the self-locking type.

At this point other details of the illustrated embodiment will be explained below.

First of all, it is provided that the step-down gear 8 has a gear wheel 13, and that the lifting spring 11 is made as a leg spring which directly interacts with this gear wheel 13, the gear wheel 13 having a driving element 13*a* for one leg of the lifting spring 11. The other leg of the lifting spring 11 is supported, stationary, against an abutment 14 on the housing 1. The lifting spring 11 is wound around the middle area of the gear wheel 13. The gear wheel 13 has a fitted gear segment 13*b* which engages a corresponding gear segment 9*a* on the detent pawl lever 9 which is made as a segmented lever. The displacement of the gear segments 9*a*/13*b* relative to one another can be easily understood by a comparison of FIG. 2 with FIG. 1.

Furthermore, the preferred embodiment shown illustrates that the step-down gear 8 is comprised of several stages. In this embodiment, the step-down gear 8 is comprised of a gear wheel 15 that is part of a first gear stage which is made as a worm wheel stage. For this reason, the electric drive motor 7 has a worm 7*a* on its driven shaft, which represents the input element of the step-down gear 8 and which engages the gear wheel 15 which is used as the worm wheel. Another gear segment 13*c* on gear wheel 13 is assigned to the center crown gear 15*a* of the gear wheel 15. This gear segment 13*c* engages the crown gear 15*a* of the gear wheel 15 and the displacement with respect to one another is apparent from a comparison of FIG. 2 (open position) with FIG. 1 (locked position).

Furthermore, it is provided that a locking stop 16 and an opening stop 17 are assigned to the lifting spring 11 or the assigned gear wheel 13. In FIG. 1, the locked position, one leg of the leg spring which forms the lifting spring 11 has been pressed by the driving element 13*a* on the gear wheel 13 against the locking stop 16. In this position, the retaining element 12 has engaged, and at this point, blocks the projecting part of the leg of the lifting spring 11 so that it cannot return. When the locking stop 16 is reached, the supply current of the electric drive motor 7 is turned off and the lifting spring 11 sets back the step-down gear 8 by a small amount until further reset motion is likewise stopped by the retaining element 12.

In this construction, control of the electric drive motor 7 by monitoring the motor current (blocking mode) can be accomplished especially effectively. Then, microswitches can be saved; this entails a considerable savings of money.

FIG. 2 shows the open position of the motor vehicle door lock or the like and the lifting spring 11 with its movable leg on the opening stop 17, the electric drive motor 7 having been turned off by the blocking mode in the preferred embodiment. In the embodiment shown, the conditions are such that the driving element 13*a*, reinforced by the action of the lifting spring 11, strikes the opening stop 17, and therefore, lies between the free leg of the lifting spring 11 and the opening stop 17.

The second gear wheel 15, in this embodiment, has a catch pocket 18 for a catch projection 19 on the retaining element 12. As shown in FIG. 1, the catch projection 19 is held by the catch pocket 18 on the gear wheel 15 so that the pivot lever, which is supported on the bearing axle 12*b* and which forms the retaining element 12, cannot unintentionally move upward, therefore cannot bump, under the influence of acceleration forces. Bumping could mean that, with an appropriate force of the lifting spring 11, the motor vehicle door lock suddenly would be unintentionally opened simply by the lifting spring 11. Therefore, the gear wheel 15 acts with the catch pocket 18 as an additional safety element for the retaining element 12.

If the electric drive motor 7 for opening the motor vehicle door lock or the like is triggered in the position which is shown in FIG. 1, the gear wheel 15 is turned clockwise and presses the catch projection 19 up by means of the camming action of the sloping, trailing side edge of the catch pocket 18, so that the retaining element 12 is released from the free leg of the lifting spring 11, releasing it. At the same time, the gear wheel 13 turns counterclockwise, the driving element 13*a* leaves the lifting spring 11, and the spring 11 is shortly thereafter suddenly released as soon as the retaining element 12 has been lifted. From this instant on, the reset force of the lifting spring 11, in addition to the drive force of the electric drive motor 7, acts in the direction of opening so that the detent pawl 5 is lifted instantly and also with high forces on the locking wedge 3.

This embodiment shows another alternative which is shown in broken lines and which is characterized in that in the step-down gear 8, especially on the gear wheel 15, free-wheeling clutch 20, 21 is accomplished which guarantees that the drive motor 7 can briefly start without immediately causing a driven-side movement, especially movement of the gear wheel 13. The free-wheeling clutch 20, 21 is accomplished, here, by a driving segment 20 on one part of the gear wheel 15 and a free-wheeling segment 21 on a second part of the gear wheel 15 which can be turned relative to the first part. In the transition from FIG. 1 to FIG. 2, it is apparent that when the drive motor 7 starts, the free-wheeling angle, which is roughly 30° here, has been used up between the segments 20 and 21. This free-wheeling results in the retaining element 12 being already lifted before the movement of the drive motor 7 is transferred to the gear wheel 13, and thus, also to the detent pawl 5. In particular, in a self-locking gear, this is feasible, and moreover, has the advantage that the electric drive motor 7 can apply a low starting moment.

The embodiment shown is characterized especially in that the parts of the step-down gear 8 are made, completely or mostly of plastic. Plastic can be used because, even with high forces on the locking wedge 3, the loading of the step-down gear 8 in the released state is low.

We claim:

1. Motor vehicle door lock comprising a lock latch and a detent pawl which holds the lock latch in a locked position and a motorized opening drive having an electric drive motor and a step-down gear which, on the driven side causes the detent pawl to be lifted when the drive motor is triggered for releasing the lock latch into an open position; wherein a lifting spring is provided which acts in a lifting direction of the detent pawl, a tension force being applied to the lifting spring when the opening drive reverses for moving the lock latch from the open position into the locked position; wherein the tension force applied to the lifting spring is released when the opening drive is advanced in an opening motion for moving the locking latch from the locked position into the open position, causing said lifting spring to reinforce said opening motion and lifting of the detent pawl with a spring force applied thereby; wherein a retaining element is provided which acts as a stop for the tensioned lifting spring in the locked position; and wherein the retaining element is lifted directly after starting the advance motion of the opening drive by means of the step-down gear for releasing the lifting spring.

2. Motor vehicle door lock according to claim 1, wherein the lifting spring operates in conjunction with the step-down gear.

3. Motor vehicle door lock as claimed in claim 1, wherein the step-down gear is a self-locking gear.

4. Motor vehicle door lock as claimed in claim 1, wherein the step-down gear is a self-locking step-down gear.

5. Motor vehicle door lock as claimed in claim 1, wherein the step-down gear has a gear wheel; wherein the lifting spring is a leg spring which is mounted in association with said gear wheel, the gear wheel having a driving element which engages a leg of the lifting spring.

6. Motor vehicle door lock as claimed in claim 1, wherein the step-down gear is a multistage gearing with a first gear stage having a worn wheel.

7. Motor vehicle door lock as claimed in claim 1, wherein a locking stop and an opening stop are provided for limiting movement of the lifting spring in the locked position and the open position, respectively.

8. Motor vehicle door lock as claimed in claim 1, further comprising a motor current sensing motor control for stopping of the electric drive motor.

9. Motor vehicle door lock as claimed in claim 1, wherein the step-down gear comprises a gear wheel; wherein the gear wheel has a catch pocket for a catch projection on the retaining element; and wherein the catch projection, in the locked position, lies in the catch pocket, so that the retaining element cannot be moved away from the lifting spring by acceleration forces.

10. Motor vehicle door lock as claimed in claim 1, wherein the step-down gear comprises a gear wheel with a free-wheeling clutch for enabling the drive motor to briefly start without immediately causing a driven-side movement of the gear wheel.

11. Motor vehicle door lock as claimed in claim 1, wherein parts of the step-down gear are substantially made of plastic.

12. Motor vehicle door lock as claimed in claim 1, wherein the drive motor of the opening drive is a reversible drive motor.

13. Motor vehicle door lock according to claim 1, wherein the lock latch comprises a main catch and a preliminary catch.

14. Motor vehicle door lock according to claim 1, wherein a detent pawl lever is provided and wherein the driven side of the step-down gear engages the detent pawl lever to cause the detent pawl lever to lift the detent pawl.

* * * * *